US007524163B2

(12) United States Patent
Self et al.

(10) Patent No.: US 7,524,163 B2
(45) Date of Patent: Apr. 28, 2009

(54) NOZZLE GUIDE VANES

(75) Inventors: Kevin P Self, Bristol (GB); Mark J Simms, Bristol (GB)

(73) Assignee: Rolls-Royce plc, London (GB)

( * ) Notice: Subject to any disclaimer, the term of this patent is extended or adjusted under 35 U.S.C. 154(b) by 18 days.

(21) Appl. No.: 11/518,196

(22) Filed: Sep. 11, 2006

(65) Prior Publication Data

US 2009/0074562 A1 Mar. 19, 2009

Related U.S. Application Data

(63) Continuation-in-part of application No. 11/001,125, filed on Dec. 2, 2004, now abandoned.

(51) Int. Cl.
*F01D 25/12* (2006.01)

(52) U.S. Cl. ..... 415/115; 415/139; 415/116; 415/191; 415/211.2

(58) Field of Classification Search ..... 415/115, 415/116, 139, 191, 211.2; 164/369
See application file for complete search history.

(56) References Cited

U.S. PATENT DOCUMENTS

| | | | | |
|---|---|---|---|---|
| 4,026,659 | A * | 5/1977 | Freeman, Jr. | 415/115 |
| 4,902,198 | A * | 2/1990 | North | 415/115 |
| 5,531,457 | A * | 7/1996 | Tibbott et al. | 277/590 |
| 6,062,817 | A * | 5/2000 | Danowski et al. | 416/97 R |
| 6,254,333 | B1 * | 7/2001 | Merry | 415/115 |
| 6,340,285 | B1 * | 1/2002 | Gonyou et al. | 415/116 |

* cited by examiner

*Primary Examiner*—Ninh H Nguyen
(74) *Attorney, Agent, or Firm*—W. Warren Taltavull; Manelli Denison & Selter PLLC

(57) ABSTRACT

A turbine nozzle guide vane 10 with passages 28 leading from a hollow core 32 to respective seal strip slots 20, to deliver cooling air to abutment faces 18 on each end of the vane 10.

7 Claims, 4 Drawing Sheets

NOZZLE GUIDE VANES

This is a Continuation-In-Part of National application Ser. No. 11/001,125 filed Dec. 2, 2004 now abandoned.

FIELD OF THE INVENTION

This invention concerns turbine nozzle guide vanes for gas turbine engines, and a method of forming such nozzle guide vanes.

BACKGROUND OF THE INVENTION

Turbine nozzle guide vanes for gas turbine engines generally comprise inner and outer platforms with an aerofoil extending therebetween. Such guide vanes are formed as a plurality of segments arranged in one or more rings around an engine. It is necessary for a gap to be left between adjacent guide vanes to allow for manufacturing tolerances and thermal expansion during use. These gaps are conventionally sealed by providing cooperating slots in each guide vane, with a metal seal strip extending in the slots and between the segments.

Nozzle guide vanes are generally air cooled, and passages can be provided in the platforms and aerofoil. It is generally difficult however to cool the abutment faces between adjacent vanes, and particularly due to the provision of the seal strips extending therebetween. Higher engine gas temperatures are generally now being used which make cooling of the nozzle guide vanes increasingly important.

U.S. Pat. No. 6,254,333 discloses a stator vane having platforms that abut adjacent platforms. The platforms comprise a rear attachment rail. The abutting faces of the platforms define seal slots along their lengths and are fed with cooling air from a single passageway that is located rearward of the rear attachment rail. One problem of this design is that the single rearwardly positioned hole does not provide a sufficient supply of cooling air to the slot and therefore the front part of the abutment face and platform may become overheated resulting in adverse thermal gradients that reduce the life of the vane. U.S. Pat. No. 4,902,198 discloses a similar arrangement with a similar problem.

SUMMARY OF THE INVENTION

According to the present invention there is provided a turbine nozzle guide vane for a gas turbine engine, the nozzle guide vane includes inner and outer platforms with an aerofoil extending therebetween, at least one platform comprises a rear sealing rail and an abutment face, a seal strip slot is defined in the abutment face and is fed cooling air via at least one passage defined in the platform wherein the at least one passage has an outlet located upstream of the rear sealing rail to deliver cooling air into the strip seal slot upstream of the rear sealing rail.

Preferably, the at least one platform comprises a front sealing rail, and the outlet is located between the front sealing rail and the rear sealing rail to deliver cooling air into the strip seal slot upstream of the rear sealing rail.

Preferably, the strip seal slot extends from the front sealing rail to the rear sealing rail to deliver cooling air to the abutment face downstream from the front sealing rail.

Preferably, a first region is defined between the front sealing rail and the rear sealing rail and a second region is defined downstream of the rear sealing rail, the outlets are located adjacent first region.

Normally, the second region has a lower pressure than the first region.

Preferably, the passages extend from a main hollow core in the respective platforms to the seal strip slots.

Preferably, a plurality of passages extends to each seal strip slot.

Preferably, the turbine engine includes a plurality of nozzle guide vanes arranged in one or more rings, characterised in that the nozzle guide vanes are according to any of the preceding claims.

The invention yet further provides a method of forming turbine nozzle guide vanes for a gas turbine engine, the method including investment casting metal around a core member, which core member defines openings in the guide vane, subsequently removing the core member, wherein projections on the core member define passages extending into where seal strip slots are provided.

The seal strip slots are preferably machined into the nozzle guide vanes following removal of the core member therefrom, so as to expose ends of said passages in the slots.

BRIEF DESCRIPTION OF THE DRAWINGS

An embodiment of the present invention will now be described by way of example only and with reference to the accompanying drawings, in which:—

DETAILED DESCRIPTION OF THE INVENTION

Figure 1:
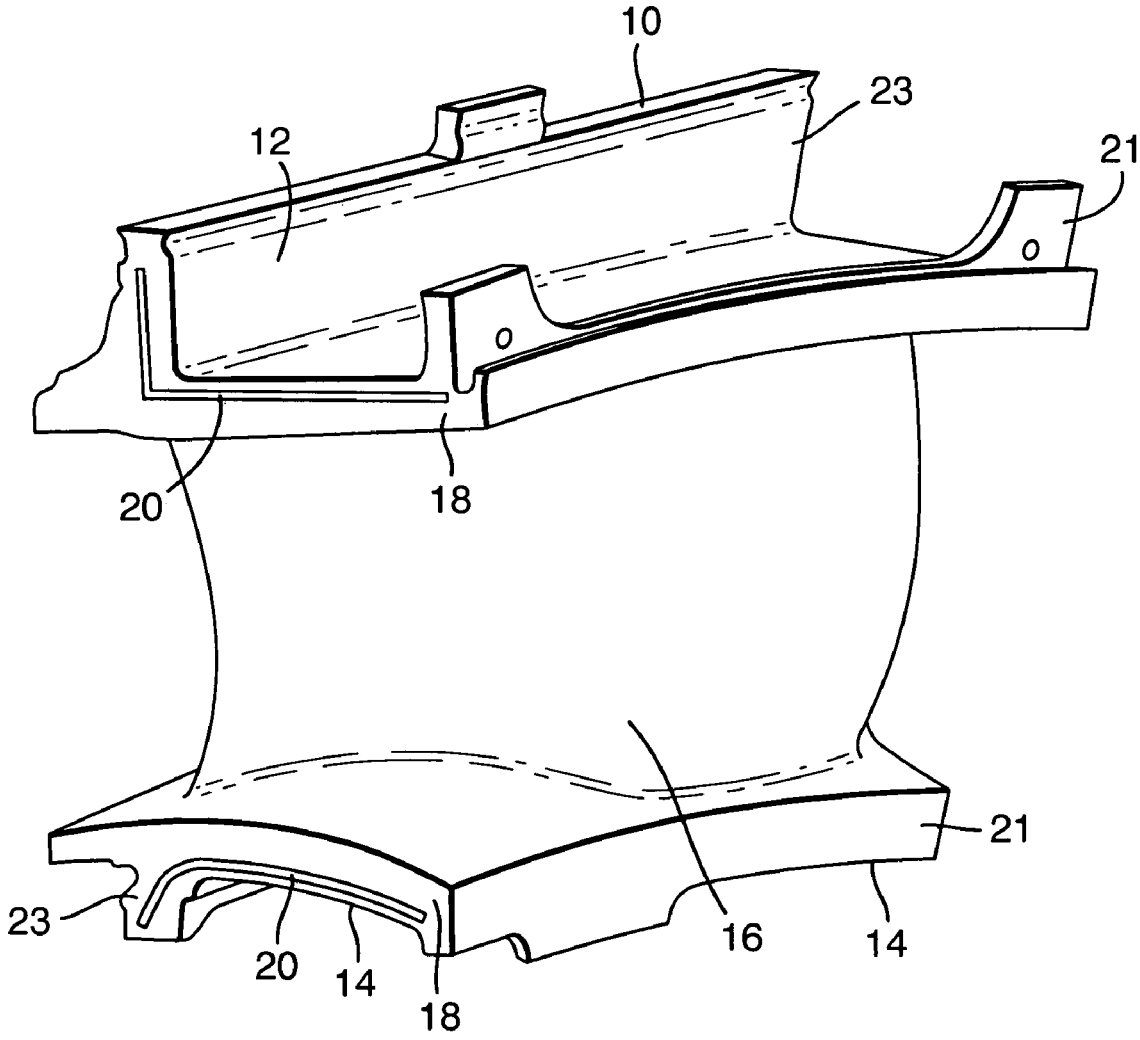
FIG. 1 is a perspective view of a nozzle guide vane according to the invention.

FIG. 1 shows a turbine nozzle guide vane 10 one of an annular array of vanes mounted between inner and outer casings (not shown). The vane 10 has an outer platform 12 and an inner platform 14. An aerofoil 16 extends between the platforms 12, 14. Abutment faces 18 are provided on the end of each of the platforms 12, 14, and seal strip slots 20 are provided in the abutment faces 18.

Figure 1A:
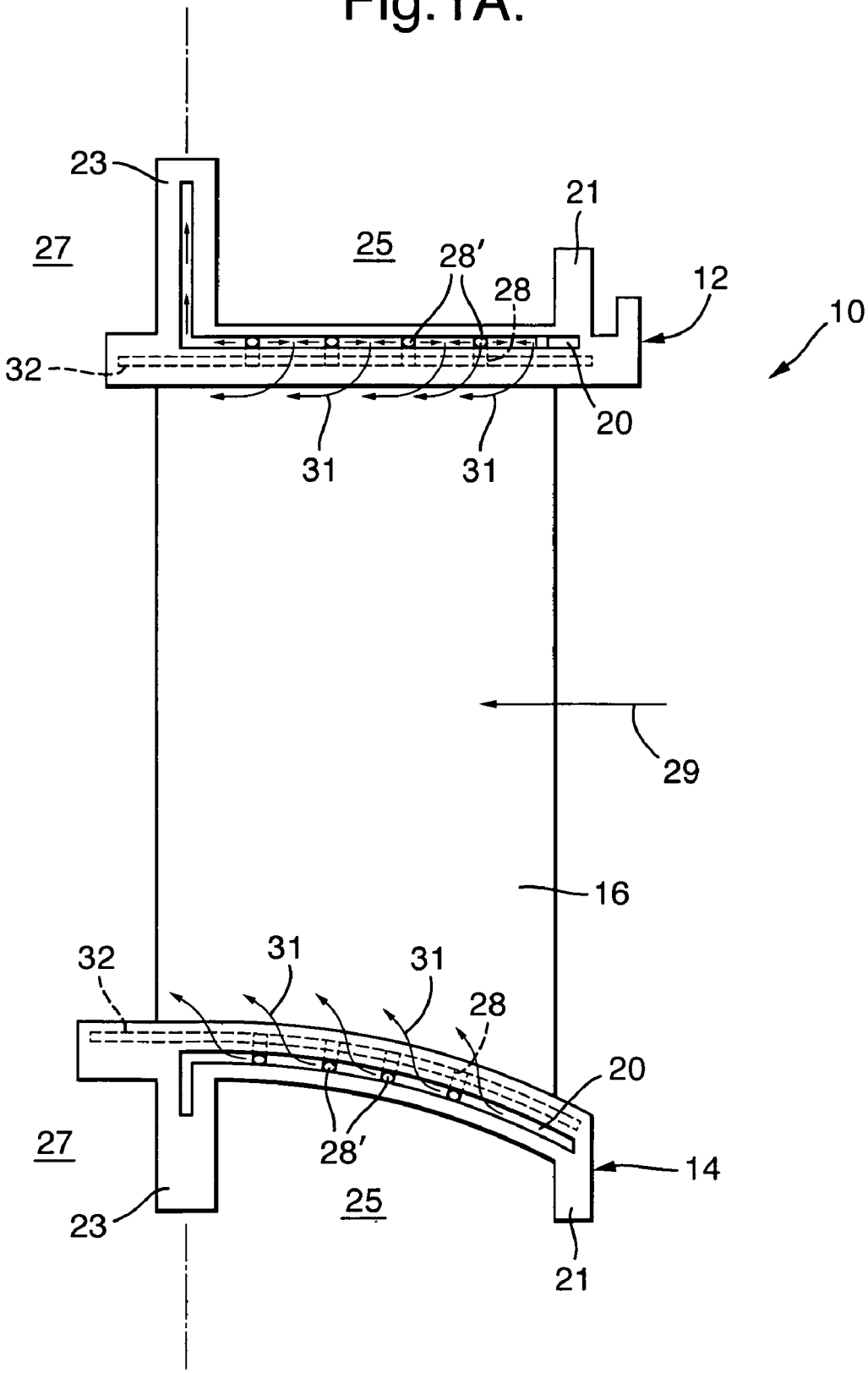
FIG. 1A is a side view of the nozzle guide vane shown in FIG. 1, showing a typical arrangement of cooling the abutment faces.

FIG. 1A is a side view of the nozzle guide vane 10 shown in FIG. 1. Working fluid flows in the direction of arrow 29. The outer platform 12 and inner platform 14 incorporate front fixing rails 21 and rear fixing rails 23. These rails 21, 23 extend circumferentially and provide both a mechanical fixing to the casings and a seal against working fluid leakage. The rails define a first region 25 therebetween and a second region 27 is defined downstream of the rear rail 23. The rails 21, 23 allow a differential pressure to exist between regions 25 and 27. The pressure in region 27 is less than 25, which mimics the reduction in pressure seen in the main working fluid stream 29 passing the aerofoil 16 due to the turbine expansion process. This pressure differential minimises leakage into main gas stream from region 27.

The seal strip slot 20 is defined in the abutment face 18 and is fed cooling air via passages 28 defined in the platforms 12, 14. The present invention is realised by the passages 28 having outlets 28' that are located upstream of the rear sealing rail 23 to deliver cooling air into the strip seal slot 20 upstream of the rear sealing rail 23. This is advantageous in that the abutment face and platform is cooled upstream of the rear sealing rail 23. As shown in FIG. 1A, the passage outlets 28' are located between the front sealing rail 21 and the rear sealing rail 23 to deliver cooling air into the strip seal slot 20 upstream of the rear sealing rail 23. The passage outlets 28' are also located adjacent first region (25).

The advantage of positioning the outlet 28' upstream of the rear sealing rail 23 is that the cooling air cools the hotter upstream parts of the platform providing a more even temperature. The array of outlets 28' shown also provides an even better cooling profile to a greater length of the slot 20. Such positioning of the outlets 28' is enabled because the sealing rails (21, 23) define a first region (25) that is pressurized similarly to the main gas flow and therefore this allows the cooling air to enter the slot and egress into the main working fluid flow as shown by the arrows 31. The prior art mentioned in the preamble does not comprise the sealing rails to define a first region, and thus supply of cooling fluid is limited to downstream of the rear attachment rail.

Figure 2:
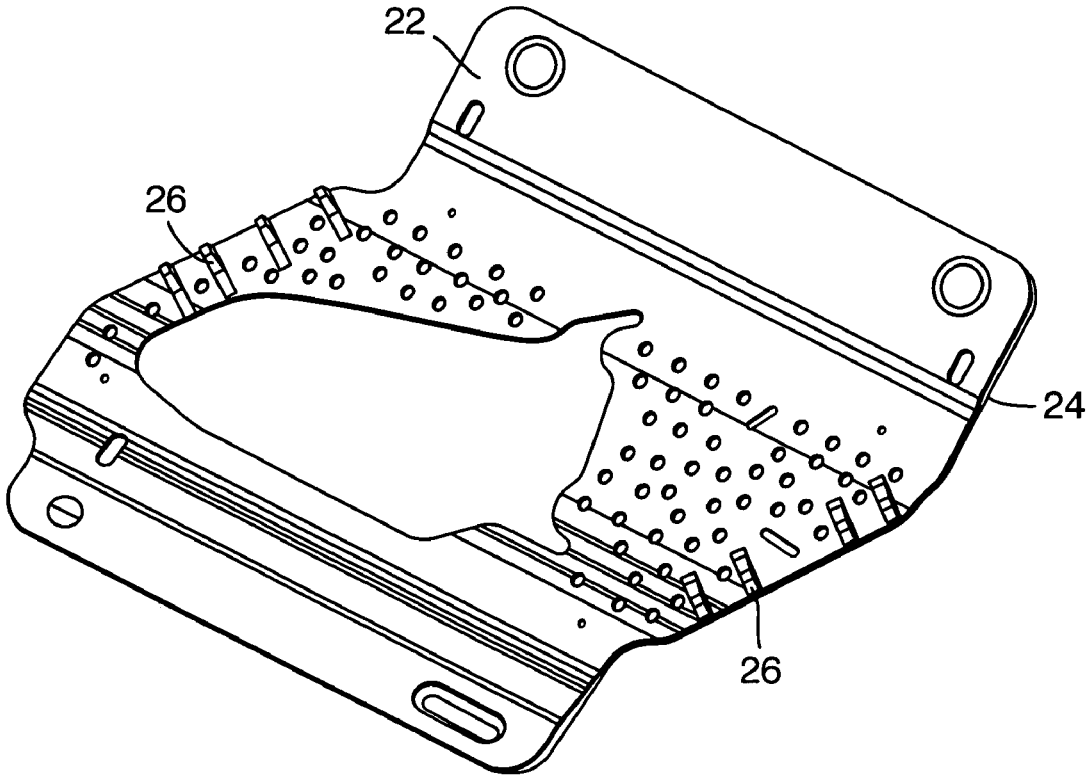
FIG. 2 is a perspective plan view of a core member usable in forming the nozzle guide vane of FIG. 1.
Figure 3:
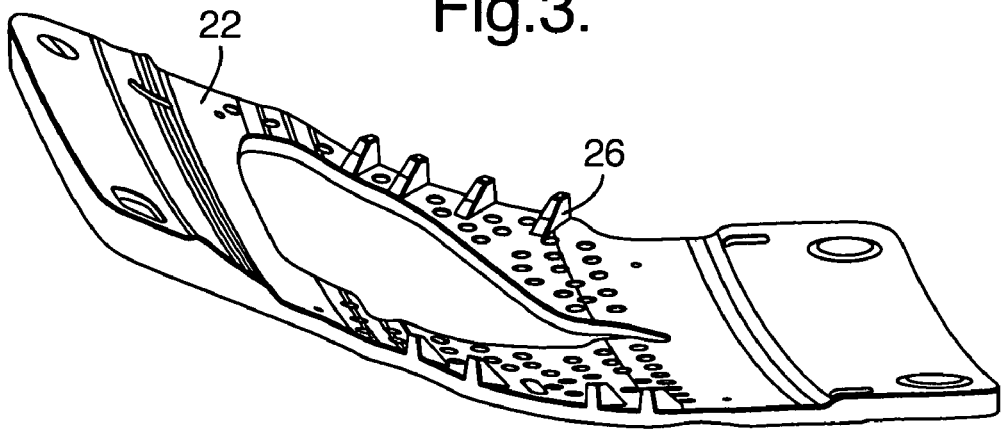
FIG. 3 is a diagrammatic perspective side view of the core member of FIG. 2.

FIGS. 2 and 3 show a ceramic core member 22 usable in investment casting of the guide vane 10. The core member 22 has a body 24 to define a main hollow core in the guide vane 10, and four inclined projections 26 extending from the body 24 to define passages 28 extending into the seal strip slots 20.

Figure 4:
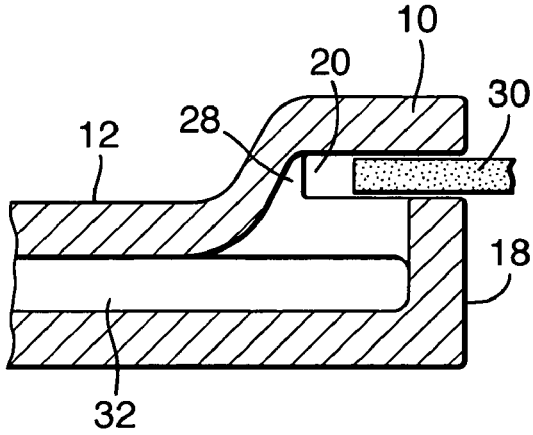
FIG. 4 is a diagrammatic cross sectional side view of part of the guide vane of FIG. 1.
Figure 5:
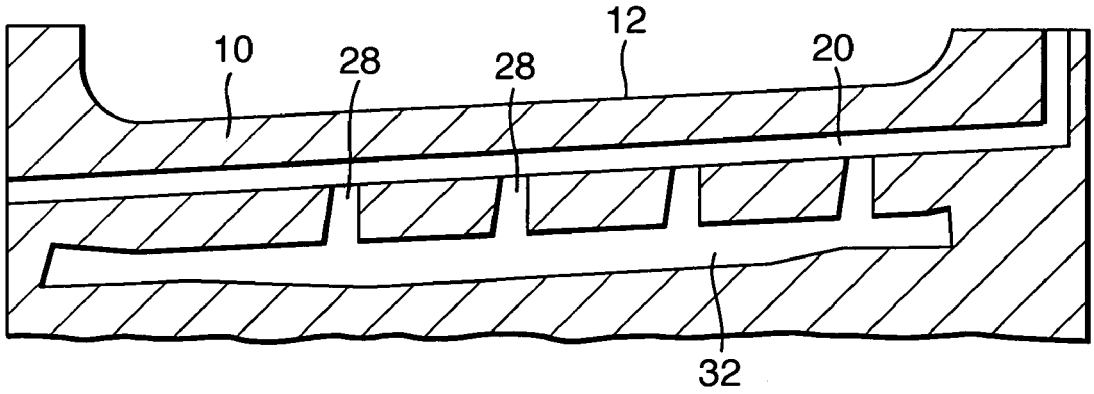
FIG. 5 is a diagrammatic end view of part of the guide vane of FIG. 1.

FIGS. 4 and 5 diagrammatically show the nozzle guide vane 10 in use. In FIG. 4 there is shown part of a seal strip 30 locating in the seal strip slot 20. FIG. 4 shows part of an outer platform 12, and above the guide vane 10 as shown in the drawing would be the coolant side at high pressure. Cooling air would be supplied through the main hollow core 32 formed in the body 24 and would then pass through the passages 28 into the seal strip slot 20. The cooling air would generally pass under the seal strip 20 as shown by the arrow, and pass across the abutment face 18 which would face a similar nozzle guide vane 10, to beneath the guide vane 10 as shown, which would be the hot gas side at a lower pressure than the cooling air within the guide vane 10.

In use, the nozzle guide vane 10 would be formed by casting an appropriate metal around the core member 22 in an appropriate shape mould. Following casting the core member 22 would be destroyed, for instance by leaching. The seal strip slots 20 would then be formed by machining until the slot 20 exposes ends of the passages 28. By inclining the projections 26 and hence passages 28, it means that this machining operation will not affect the main hollow core 32 of the guide vane 10.

There is thus described a nozzle guide vane which provides for cooling of the abutment edge and is thus suitable for use at high gas temperatures. No additional manufacturing processes or steps are required in forming such a nozzle guide vane, and therefore such guide vanes can readily be manufactured.

Various modifications may be made without departing from the scope of the invention. For instance, a different number of passages may be provided, and these may be of a different shape, or the passages may be positioned both upstream and downstream the rear fixing rails.

Whilst endeavouring in the foregoing specification to draw attention to those features of the invention believed to be of particular importance it should be understood that the Applicant claims protection in respect of any patentable feature or combination of features hereinbefore referred to and/or shown in the drawings whether or not particular emphasis has been placed thereon.

The invention claimed is:

1. A turbine nozzle guide vane for a gas turbine engine having a main hollow core and a casing wherein air flows in use from a forward end downstream to a rear end of said hollow core and wherein the nozzle guide vane includes inner and outer platforms with an aerofoil extending therebetween, at least one platform comprises a front sealing rail, a rear sealing rail for mechanically fixing the nozzle guide vane to the casing for sealing a working fluid against leakage and an abutment face with said rear sealing rail being located closer to said rear end of said hollow core than said front sealing rail, a seal strip slot is defined in the abutment face and is fed cooling air via at least one passage defined in the platform wherein the at least one passage has an outlet located within said seal strip slot, upstream of the rear sealing rail and downstream of the front sealing rail, to deliver cooling air into the strip seal slot upstream of the rear sealing rail wherein the passage extends from the main hollow core in the respective platform to the seal strip slot to supply cooling air from the main hollow core to the seal strip slot.

2. A turbine nozzle guide vane according to claim 1, wherein the outlet is located between the front sealing rail and the rear sealing rail to deliver cooling air into the strip seal slot upstream of the rear sealing rail.

3. A turbine nozzle guide vane according to claim 2, wherein the strip seal slot extends from the front sealing rail to the rear sealing rail to deliver cooling air to the abutment face downstream from the front sealing rail.

4. A turbine nozzle guide vane according to claim 2, wherein a first region is defined between the front sealing rail and the rear sealing rail and a second region is defined downstream of the rear sealing rail, the outlets are located adjacent first region.

5. A turbine nozzle guide vane according to claim 4, wherein the second region has a lower pressure than the first region.

6. A turbine nozzle guide vane according to claim 1, characterised in that a plurality of passages extend to each seal strip slot.

7. A guide vane according to claim 1, characterised in that the seal strip slots are machined into the nozzle guide vanes following removal of the core member therefrom so as to expose ends of said passages in the slots.

* * * * *